US005382215A

United States Patent [19]

Mattiebe

[11] Patent Number: 5,382,215

[45] Date of Patent: Jan. 17, 1995

[54] PROCESS FOR PRODUCING PAPER BAGS WITH HANDLES

[75] Inventor: Günter Mattiebe, Bielefeld, Germany

[73] Assignee: Windmoller & Holscher, Lengerich/Westf., Germany

[21] Appl. No.: 152,172

[22] Filed: Nov. 16, 1993

[30] Foreign Application Priority Data

Nov. 16, 1992 [DE] Germany ..... 4238655

[51] Int. Cl.[6] ..... B31B 37/86; B31B 23/14; B31B 23/26

[52] U.S. Cl. ..... 493/221; 493/226; 493/926

[58] Field of Search ..... 493/221, 226, 228, 231, 493/234, 238, 254, 926

[56] References Cited

U.S. PATENT DOCUMENTS

| | | | |
|---|---|---|---|
| 2,346,710 | 4/1944 | Steen | 493/221 |
| 3,439,591 | 4/1969 | Class | 493/221 |
| 3,507,194 | 4/1970 | Schwarzkopf | 493/196 |
| 3,722,377 | 3/1973 | Hayes | 493/221 |
| 4,790,804 | 12/1988 | Goutou et al. | 493/226 |

FOREIGN PATENT DOCUMENTS

| | | | |
|---|---|---|---|
| 1904352 | 8/1970 | Germany | 493/226 |

*Primary Examiner*—William E. Terrell
*Attorney, Agent, or Firm*—Keck, Mahin & Cate

[57] ABSTRACT

A process for producing paper bags with handles glued to the insides of the facing opening edges, includes perforating a paper web with transverse perforation lines spaced at distances corresponding to the section lengths necessary to produce the bags. At a given distance from the transverse perforation lines the handles are glued in adjacent pairs to the web in such a way that the outer handle parts project beyond the transverse perforation lines. The web is joined together into a tubular web by folding over its side edges, such that the handles face each other. The overlapping side edges that have been folded together are glued to form a seam. The sections are detached along the transverse perforation lines and each section is provided with a bottom portion at the end opposite the handles. Adhesive coatings are applied to the web in a transverse direction between arms of the handle and Z-shaped folds are made in the adhesive area and folded onto the adhesive, using pressure, to prevent the upper edge of the bag from tearing.

11 Claims, 2 Drawing Sheets

PROCESS FOR PRODUCING PAPER BAGS WITH HANDLES

FIELD OF THE INVENTION

The invention relates to a process for producing paper bags with handles glued to the insides of the facing opening edges, in which a paper web is provided with transverse perforation lines at distances corresponding to the section lengths necessary to produce the bags. At a given distance from the transverse perforation lines the handles are glued in adjacent pairs to the web in such a way that the outer handle parts project beyond the transverse perforation lines.

The web is joined together into a tubular web by folding over its lateral edges, such that the handles face each other. The overlapping lateral edges that have been folded together are glued to form a seam. The sections are detached along the transverse perforation lines and each section is provided with a bottom portion at the end opposite the handles.

BACKGROUND OF THE INVENTION

The handle bags produced by a known process include opening edges which are formed by tear lines and handles which extend beyond the edges. The handle arms are glued to the inner faces of the bag with reinforcing strips immediately below the opening edges. The opening edges formed by the tear lines not only give the bag an unattractive appearance; they also tear easily, so that the bag may be destroyed or reduced in its utility. It is therefore desirable to reinforce the bag by folding over the opening edges and then gluing the folded over portions together.

SUMMARY OF THE INVENTION

The purpose of the invention, therefore, is to create a process for the production of bags having opening edges which are provided with folded over reinforced portions.

The invention solves this problem by providing a process in which, in the area in which the handles are glued, the web is provided with adhesive coatings between the handle arms and with Z-shaped folds having two parallel fold lines which lie in the area of the handle arms. When the individual sections are torn from a tubular web that has been folded and glued according to the invention, the result is a bag workpiece whose edges are folded inward, with the areas folded on top of each other being glued together. In forming the Z-folds the arms of the handles are also folded against each other, so that the handles lie on the inside of the bag section. When the sections have been provided with a bottom portion, the result is a bag with opening edges that are formed by folded edges, i.e., the opening edges are formed by folding over the edges of the bag workpiece. To use these bags as bags with handles, the bags must first be opened by the user and the handles pulled out.

The inwardly folded handles also provide an advantage in that before being used the carrying bags have a rectangular form, without the handles projecting beyond the opening edges. As the handles are folded, the opening sides have approximately the same thickness as the bottom areas that are formed by folds, so that a handle bag produced according to the invention process can be advantageously stacked into straight stacks having edges which are flush. This is an advantage both for storage purposes and in keeping the bags ready for use.

The Z-shaped folds can be expediently made by applying the transverse perforation lines to the area of the fold edges which are used to fold the web side opposite the handles partially onto itself. The Z-shaped folds will preferably be applied in such a way that the transverse perforation lines lie on the web parts that overlap the center line of the folds. This procedure facilitates tearing off the bag workpieces from the tubular web without the folded edge areas being inadvertently pulled out again.

It is useful to prepare for the folding process by applying pre-creasing lines.

In a further embodiment of the invention, the handle arms are provided with pre-creasing lines which lie between the adhesive areas and the adjacent pre-creasing lines. In this manner it is assured that the adhesive areas are below the opening edges formed by fold edges, and this in turn results in reinforcement of the opening edges.

The web may be expediently provided with four stamped holes corresponding roughly to the width of the handle arms and positioned adjacent to the transverse perforation lines. These holes are applied in such a way that when the handles are pulled out from the carrying bag the adhesive areas positioned at the edge and formed by the folds do not have to be torn apart.

Upon or after forming the web tube the web may be expediently provided with side folds by folding over the side portions. This results in bags with side gussets, which can be more easily filled than bags provided only with simple folds.

The sections torn from the web can be provided in a conventional manner with block-shaped or cross-shaped bottom portions.

BRIEF DESCRIPTION OF THE DRAWINGS

An exemplary embodiment of the invention will be described in greater detail on the basis of the drawings. The drawings show.

DETAILED DESCRIPTION OF THE PREFERRED EMBODIMENTS

Figure 1:
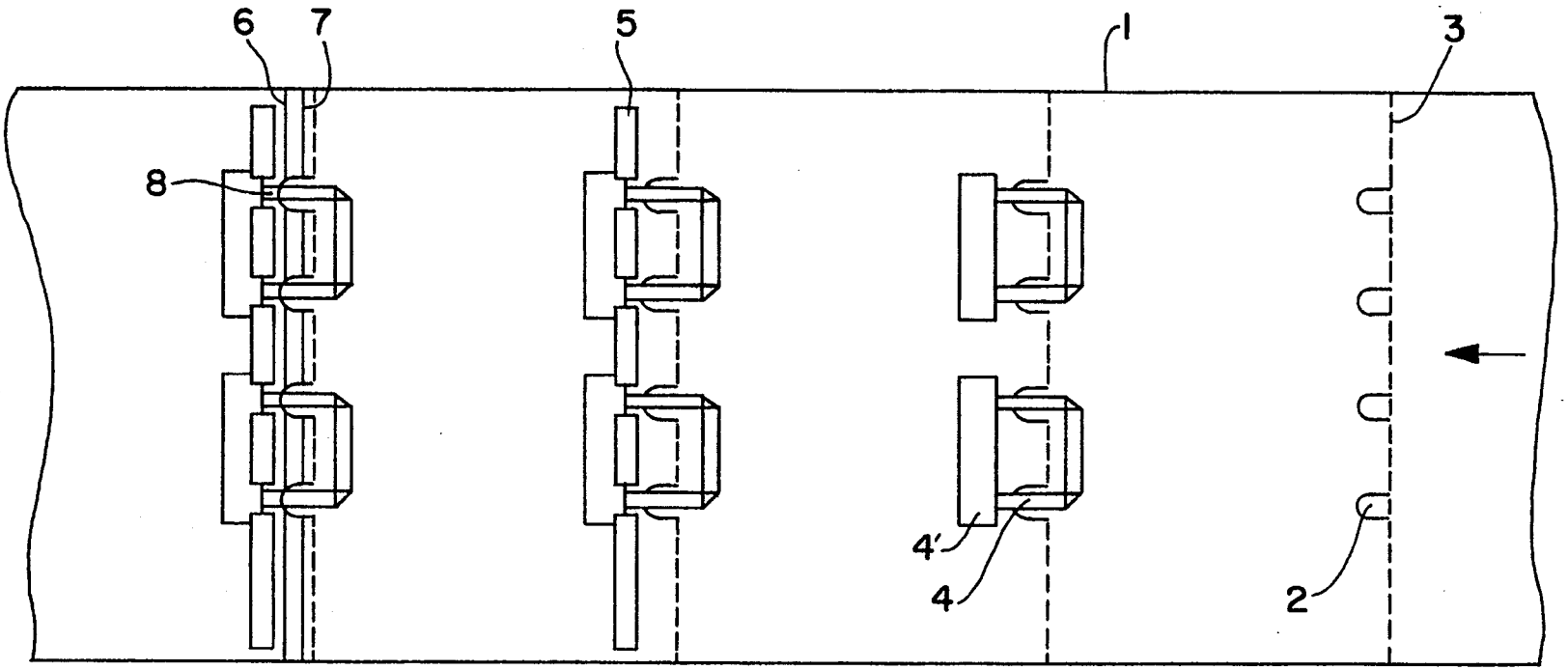
FIG. 1 is a schematic plan view of a continuous paper web showing sequential production steps.

A paper web which may be a kraft paper web and which is moved in the direction of the arrow is provided with transverse perforation lines 3 at distances representing the section length of a bag workpiece. Elongated holes 2 are punched out along the border of the perforation lines 3. The position of these holes 2 coincides with the arms of the handles applied in the next processing step. The punched holes 2 are applied to the side of the transverse perforation lines 3 which later forms the opening edge of the bags.

In the next processing step the handles 4 are glued on in such a way that the handle cross-pieces project beyond the perforation lines 3. The handles 4 consist of folded multi-layer paper strips, which are folded in the manner shown to form a U-shaped handle. The ends of the handle arms are provided with reinforcing strips 4' which also serve for gluing the handle 4 to the flat paper web 1.

In the next processing step adhesive coatings 5 are applied between the handle arms, in the area of the forward edges of the reinforcing strips 4' which serve for gluing the handle.

In the next processing step the web is provided with two parallel pre-creasing lines 6, 7 which lie between the adhesive coatings 5 and the perforation lines 3 and run below the handle arms, which are not covered by the pre-creasing line.

The handle arms are also provided with a pre-creasing line which lies between the adhesive coatings 5 and the pre-creasing line 6. The pro-creasing lines 8 which cover only the handle arms are located approximately in the terminal area of the stamped out holes 2.

Figure 2:
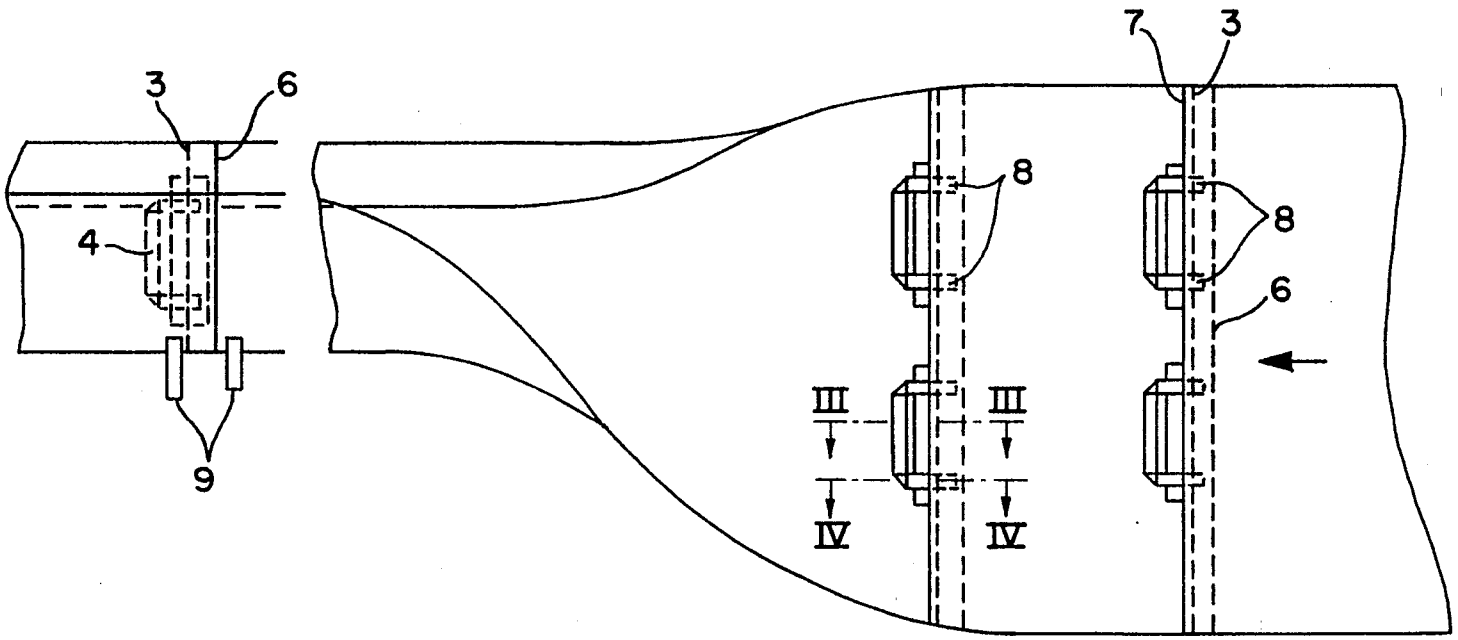
FIG. 2 is a further schematic plan view of a continuous paper web, showing further sequential production steps.
Figure 2A:
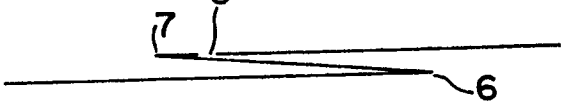
FIG. 2*a* is a cross-sectional view taken along line III—III in FIG. 2.

In the next processing step, the web is folded along the pre-creasing lines 6, 7 into Z-shaped folds, in the manner illustrated in FIGS. 2 and 2*a*, such that the pre-creasing lines 6, 7 form the fold edges. By means of these folds the web section located between the folding lines 6, 7 is folded onto the adhesive coatings 5, and the web section adheres to the adhesive coatings with the application of pressure. The transverse perforation lines 3 lie behind the fold edge 7, as can be seen in FIGS. 2 and 2*a*.

With the formation of the Z-fold, the handle arms of the handles 4 are also folded 180° over themselves and the folding lines are displaced relative to the fold edges 6.

In the following processing step the lateral portions of the web are folded over so that the web is brought together to form a tube in which the handles precisely overlap with each other. The overlapping edge areas of the folded over sides are glued together in a conventional way.

The individual bag workpieces are detached from the tubular web thus formed and are provided with bottom portions, to provide bags that are ready for use.

What is claimed is:

1. A process for producing paper bags with handles glued to the insides of the facing opening edges, comprising providing a paper web with transverse perforation lines at distances corresponding to the length of a section necessary to produce bag, gluing handles to the web in adjacent pairs at a given distance from the transverse perforation lines, wherein the outer handle parts project beyond the transverse perforation lines, joining side edges of the web together into a tubular web by folding over the side edges, such that the handles face each other and the overlapping side edges that have been folded over are glued together, detaching the sections along the transverse perforation lines, and providing bottom portions at ends of the bags opposite the handles, said process further comprising:

providing the web with adhesive coatings in a transverse direction between arms of a handle in the area in which the handles are glued on, and providing Z-shaped folds comprising two parallel fold lines lying in the area of the handle arms.

2. A process according to claim 1, comprising preparing the Z-shaped folds wherein the transverse perforation lines lie in the area of the fold edges that are used in partially folding onto itself the web side opposite the handles.

3. A process according to claim 2, comprising preparing the Z-shaped folds wherein the transverse perforation lines lie on web parts overlapping the center line of the folds.

4. A process according to claim 1, comprising preparing the Z-shaped folds by applying pre-creasing lines.

5. A process according to claim 4, comprising providing the handle arms with pre-creasing lines which lie between the adhesive areas and adjacent pre-creasing lines.

6. A process according to claim 1, comprising providing the web adjacent the transverse perforation lines with four stamped holes having a width approximately corresponding to that of the handle arms.

7. A process according to claim 1, further comprising forming side folds in the web for forming side gussets on the bags.

8. A process according to claim 7, comprising creasing the side edges before folding the sides and gluing the sides together to form a tube.

9. A process according to claim 7, comprising creasing the side edges after folding the sides and gluing the sides together to form a tube.

10. A process according to claim 1, wherein the sections torn from the web are provided with block-shaped bottom portions.

11. A process according to claim 1, wherein the sections torn from the web are provided with block-shaped bottom portions.

* * * * *